US012342972B2

(12) United States Patent
Ibeabuchi

(10) Patent No.: US 12,342,972 B2
(45) Date of Patent: Jul. 1, 2025

(54) BACK SCRUBBING DEVICE

(71) Applicant: Humphrey Ibeabuchi, Houston, TX (US)

(72) Inventor: Humphrey Ibeabuchi, Houston, TX (US)

( * ) Notice: Subject to any disclaimer, the term of this patent is extended or adjusted under 35 U.S.C. 154(b) by 141 days.

(21) Appl. No.: 18/386,479

(22) Filed: Nov. 2, 2023

(65) Prior Publication Data

US 2025/0143519 A1 May 8, 2025

(51) Int. Cl.
*A47K 7/04* (2006.01)
*A47K 7/02* (2006.01)
*A47K 7/03* (2006.01)

(52) U.S. Cl.
CPC ..... *A47K 7/04* (2013.01); *A47K 7/024* (2013.01); *A47K 7/03* (2013.01)

(58) Field of Classification Search
CPC ..... A47K 7/022; A47K 7/024; A47K 7/03; A47K 7/04
USPC ..... 4/606
See application file for complete search history.

(56) References Cited

U.S. PATENT DOCUMENTS 3,292,250 A 12/1966 Miller
D245,829 S 9/1977 Cowan
5,345,640 A * 9/1994 Goss ..... A47K 7/04 4/606
5,421,073 A 6/1995 Johnson
5,477,598 A 12/1995 Borner, Jr.
6,871,390 B1 3/2005 Liu
9,609,984 B1 * 4/2017 Kelly ..... A47K 7/04
10,201,253 B1 * 2/2019 Jackson ..... A47K 7/024
11,399,670 B1 * 8/2022 Orange ..... A47K 7/03
2009/0113616 A1 * 5/2009 Daly, Sr. ..... A47K 7/024 4/606
2009/0241257 A1 * 10/2009 Malta ..... A47K 7/024 4/606
2012/0304431 A1 12/2012 Zachary
2015/0190913 A1 7/2015 Williams

* cited by examiner

*Primary Examiner* — Tuan N Nguyen

(57) ABSTRACT

A back scrubbing device for washing a back of a user while the user is bathing includes a housing having a first wall, a second wall, and a perimeter wall that is attached to and extends between the front and second walls defining an interior area. The first wall has a top edge. A panel is coupled to the first wall and extends upwardly from the top edge. A brush is movably coupled to the panel. A drive mechanism is coupled to the brush and the processor for moving the brush vertically over the panel. A container fluidly coupled to the brush holds a cleanser. A pump device coupled to the housing directs a fluid into the container to mix with the cleanser and form a cleaning solution. A nozzle fluidly coupled to the container is exposed within the panel to dispense the cleaning solution onto the brush.

19 Claims, 8 Drawing Sheets

BACK SCRUBBING DEVICE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to scrubbing devices and more particularly pertains to a new scrubbing device for washing a back of a user while the user is bathing.

(2) Description of Related Art Including Information Disclosed Under 37 CFR 1.97 and 1.98

The prior art relates to scrubbing devices. The prior art discloses brushes and back scrubbers that generally include a brush or sponge attached to a long handle. The user can grip the handle and use it to manipulate the brush or sponge over their back while bathing. These devices are useful for users who have minimal flexibility or who have difficulty reaching their hands and arms around themselves to clean their backs. However, these devices are typically controlled manually. They are therefore minimally useful for individuals who, because of injury, age, illness, or disability, are unable to move their arms or reach their backs. Thus, there is a need for an automated scrubbing device that can be used for handsfree cleaning of a user's back while the user is bathing.

(h) BRIEF SUMMARY OF THE INVENTION

An embodiment of the disclosure meets the needs presented above by generally comprising a housing having a first wall, a second wall, and a perimeter wall that is attached to and extends between the front and second walls defining an interior area. The first wall has a top edge. A processor is positioned in the interior area. A brush assembly is coupled to the housing. The brush assembly generally includes a panel that is coupled to the first wall and extends upwardly from the top edge. A brush is movably coupled to the panel such that the brush moves along a longitudinal plane of the panel. A drive mechanism is coupled to the brush for moving the brush vertically over the longitudinal plane of the panel. A container is fluidly coupled to the brush assembly that holds a cleanser. A pump device is coupled to the housing and directs a fluid into the container. The fluid mixes with the cleanser to form a cleaning solution. A nozzle is fluidly coupled to the container and to the brush assembly and is exposed within the panel above the brush to dispense the cleaning solution onto the brush.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
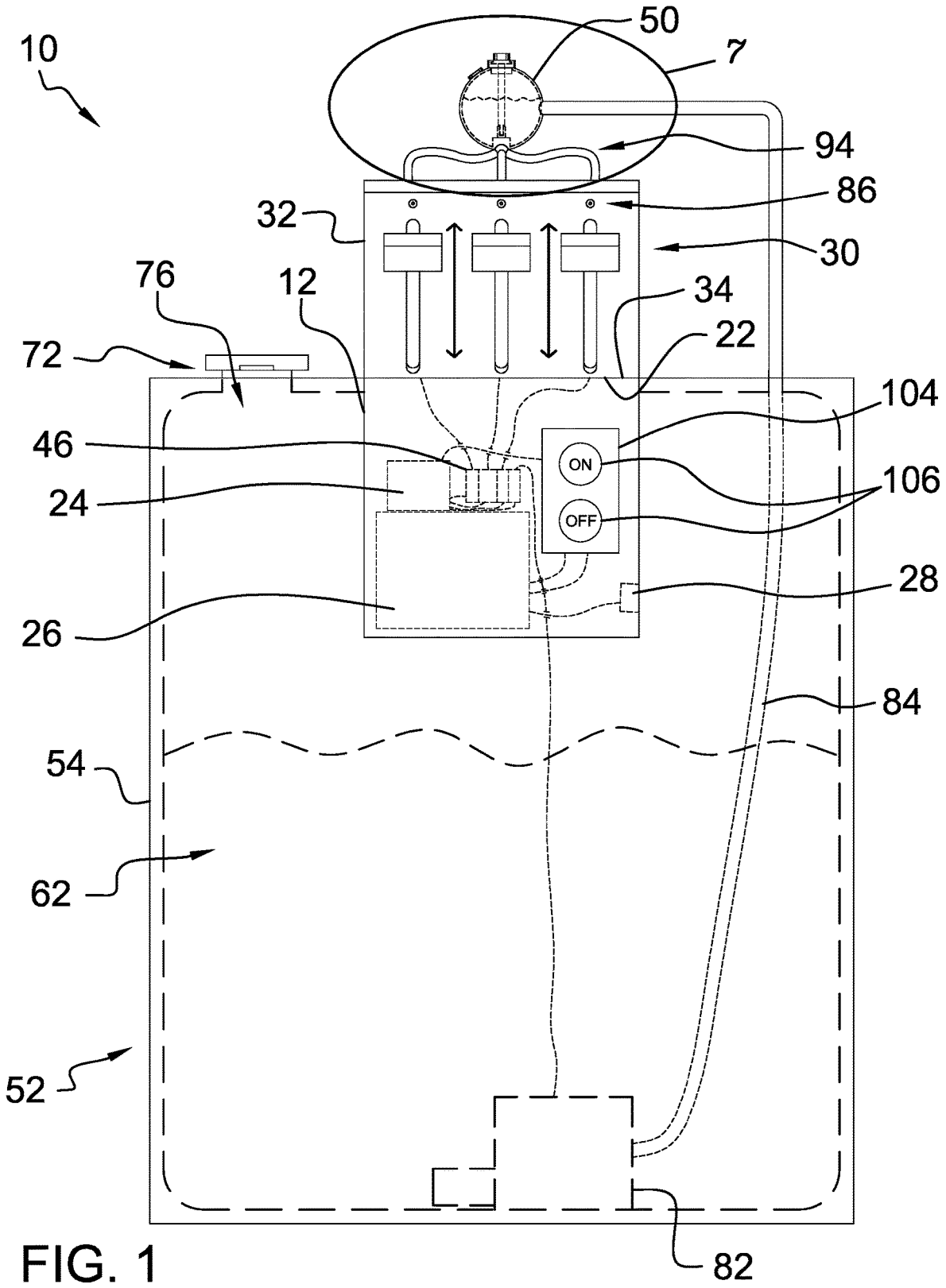
FIG. 1 is a front view of a back scrubbing device according to an embodiment of the disclosure.
Figure 2:
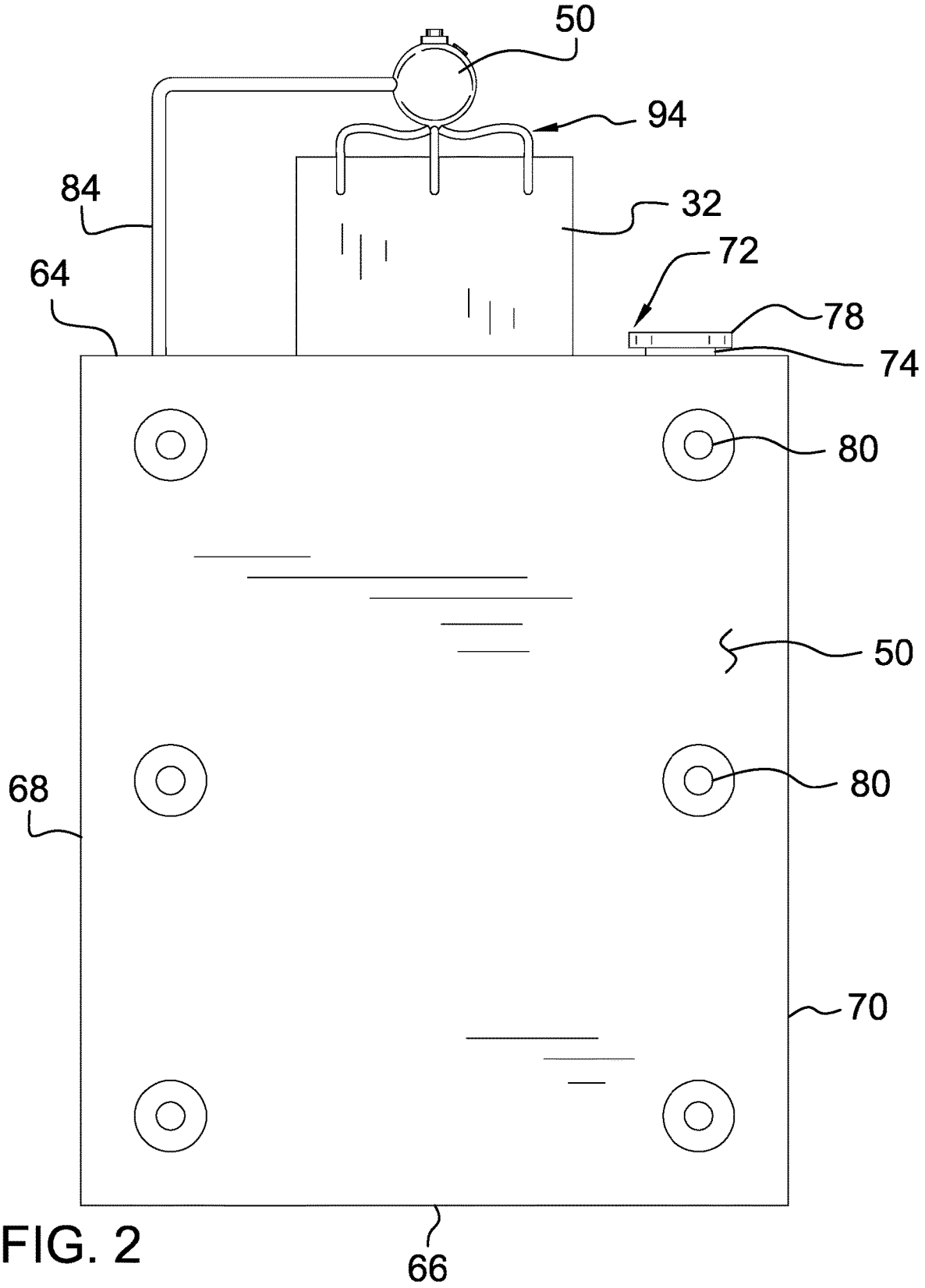
FIG. 2 is a rear view of an embodiment of the disclosure.

With reference now to the drawings, and in particular to FIGS. 1 through 7 thereof, a new scrubbing device embodying the principles and concepts of an embodiment of the disclosure and generally designated by the reference numeral 10 will be described.

As best illustrated in FIGS. 1 through 7, the back scrubbing device 10 generally comprises a housing 12 having a first wall 14, a second wall 16, and a perimeter wall 18 that is attached to and extends between the first 14 and second 16 walls defining an interior area 20. The first wall 14 has a top edge 22.

A processor 24 is positioned in the interior area 20. A power source 26 may be positioned in the interior area 20 that is electronically coupled to the processor 24. For example, the power source 26 may comprise a battery, such as a rechargeable battery. In such embodiments, a charging port 28 may be electronically coupled to the power source 26. The charging port 28 is generally inset into the housing 12 and exposed within the housing 12, for example being positioned on the perimeter wall 18 or the first wall 14.

Figure 3:
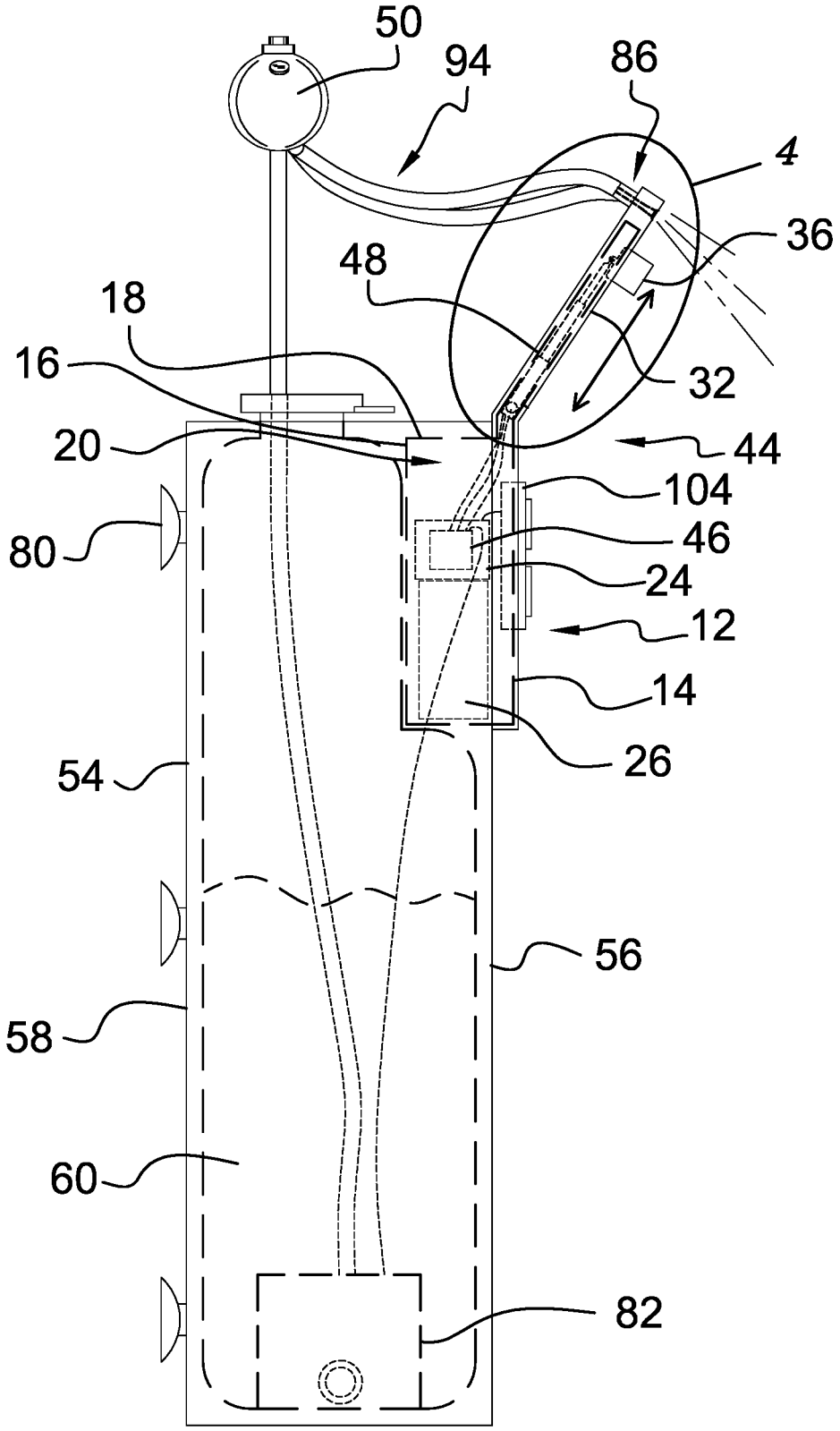
FIG. 3 is a side view of an embodiment of the disclosure.
Figure 4:
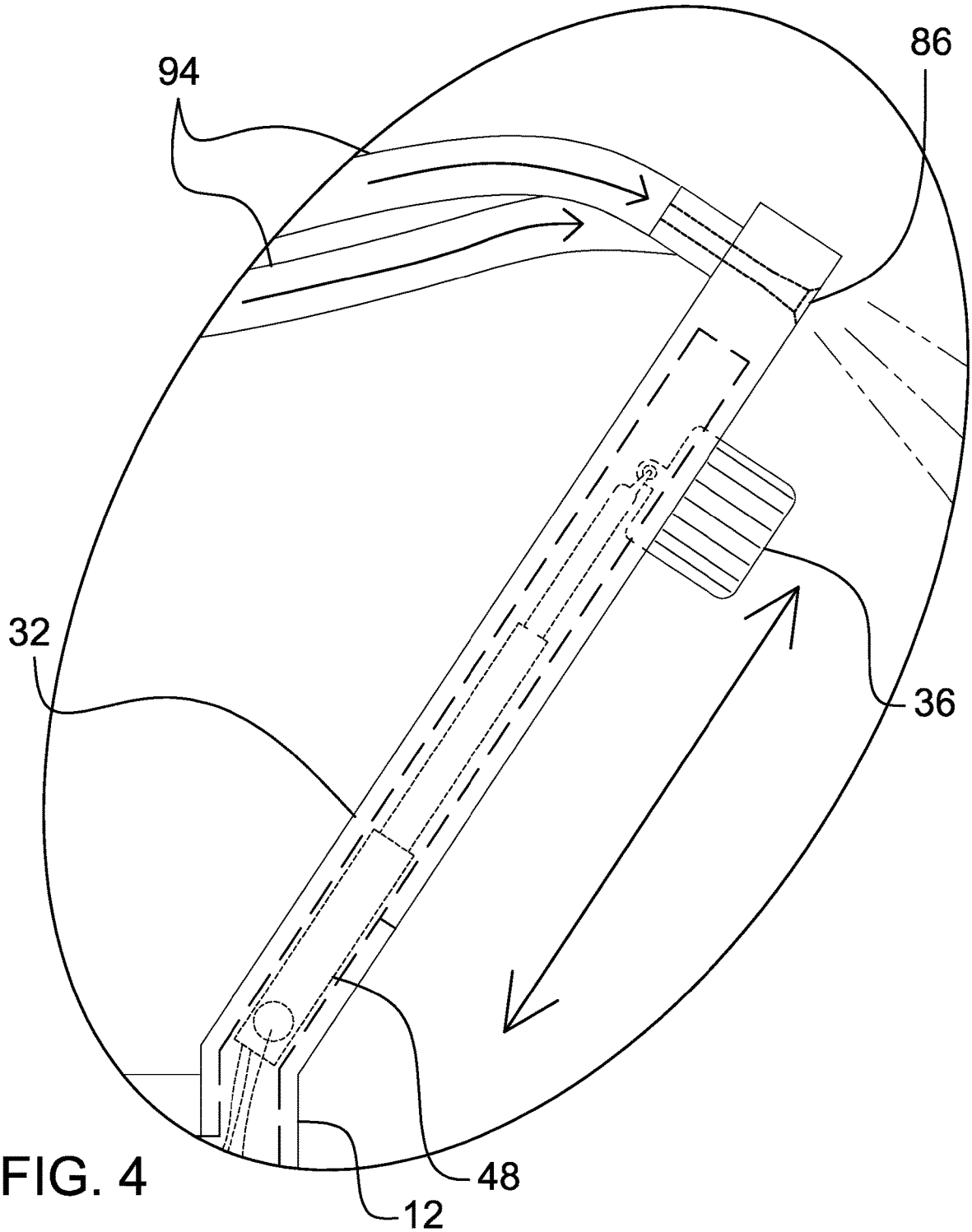
FIG. 4 is a detail view of an embodiment of the disclosure.
Figure 5:
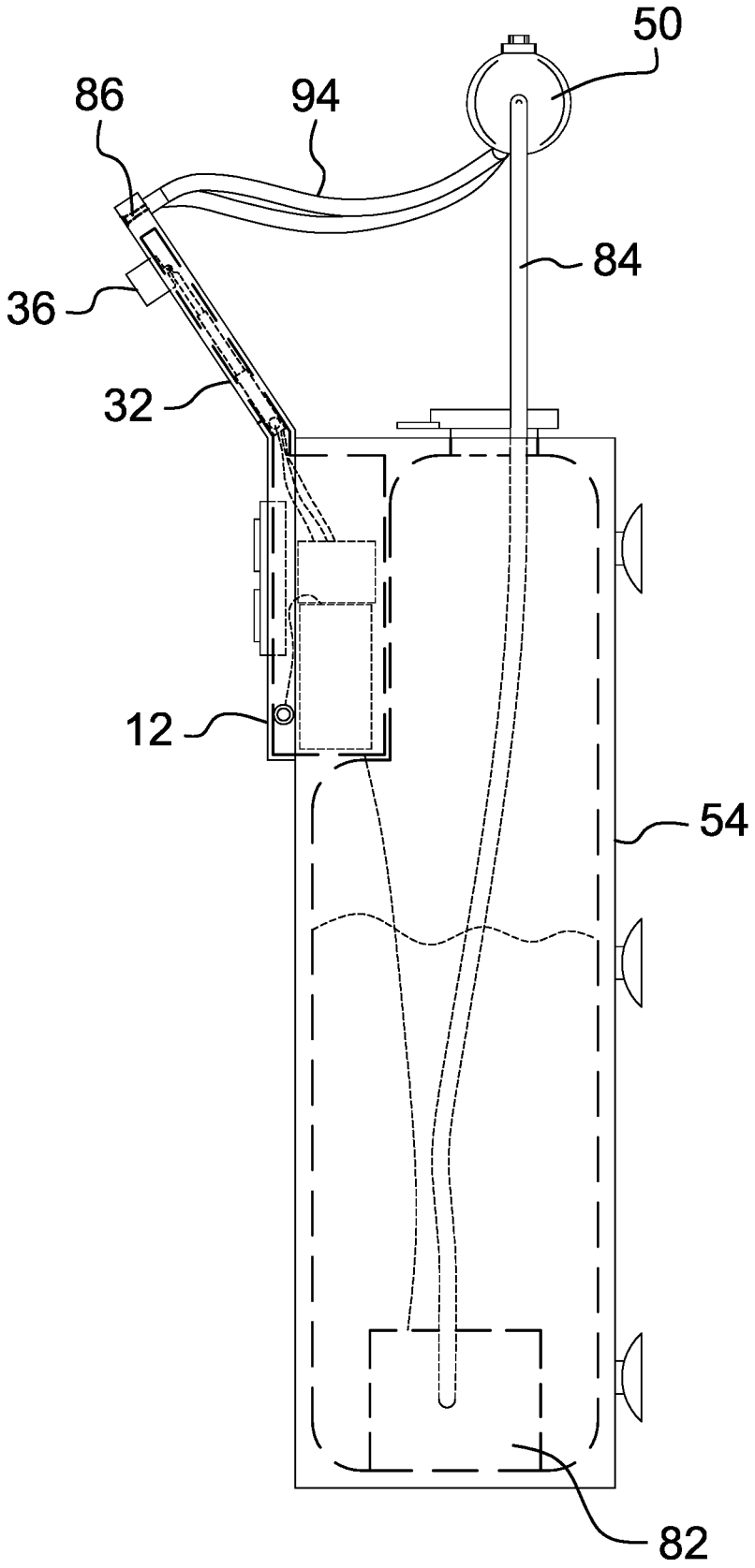
FIG. 5 is a side view of an embodiment of the disclosure.
Figure 6:
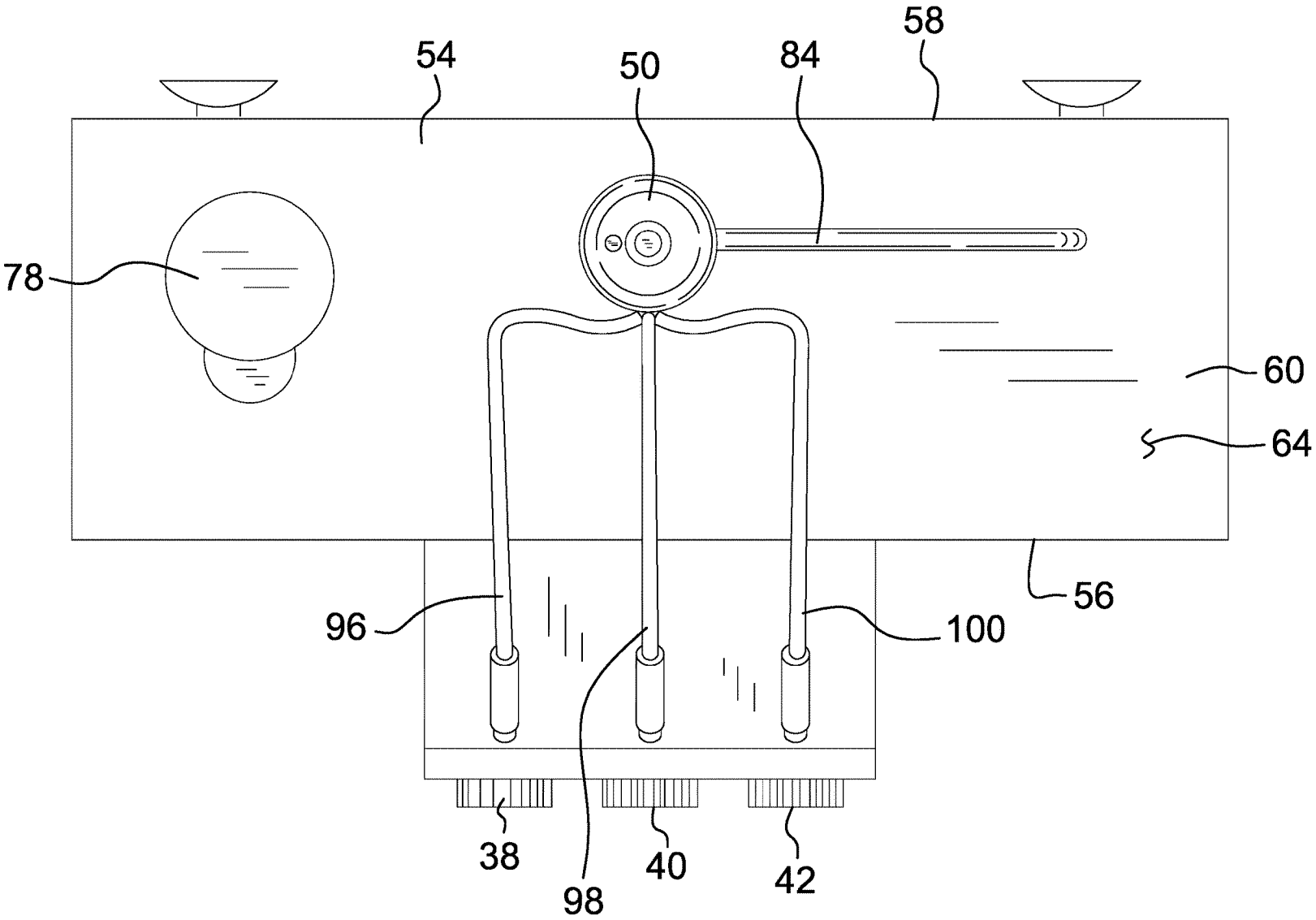
FIG. 6 is a top view of an embodiment of the disclosure.

A brush assembly 30 is coupled to the housing 12. The brush assembly 30 generally includes a panel 32 that is coupled to the first wall 14 of the housing 12. The panel 32 may extend upwardly from the top edge 22, for example when the panel 32 has a bottom edge 34 that is adjacent to and coplanar with the top edge 22 of the housing 12. The panel 32 may be angled relative to the top edge 22, as shown in FIG. 3.

The brush assembly 30 also includes a brush 36 that is movably coupled to the panel 32. The brush 36 moves along a longitudinal, or vertical, plane of the panel 32. For example, the brush 36 may include a first brush head 38, a second brush head 40, and a third brush head 42. Each of the first 38, second 40, and third 42 brush heads is aligned with the others and is spaced from the others across a transverse, or horizontal, plane of the panel 32. In alternative embodiments, the brush 36 may include only the first brush head 38. In other embodiments, the brush 36 may include more than three brush heads.

The brush assembly 30 may also include a drive mechanism 44 that is coupled to the brush 36. The drive mechanism 44 moves the brush 36 vertically over the longitudinal plane of the panel 32. For example, the drive mechanism 44 may comprise a motor 46 that is coupled to the processor 24 and an actuator 48 that is electronically coupled to the motor 46 and that is mechanically coupled to the brush 36. In some embodiments, the actuator 48 is a linear actuator.

A container 50 is fluidly coupled to the brush assembly 30. The container 50 is generally configured to hold a cleanser. For example, the container 50 may have an inlet 108 through which the cleanser may be received by the container 50. The container 50 may also include a lid 110 that is removably couplable to the inlet 108 to selectively close the inlet 108.

A pump device 52 is coupled to the housing 12. The pump device 52 is configured to direct a fluid into the container 50. The fluid mixes with the cleanser when the fluid is pumped into the container 50 thereby forming a cleaning solution.

For example, the pump device 52 may generally comprise a reservoir 54 that is configured to hold the fluid. The reservoir 54 may have a front wall 56, a back wall 58, and a peripheral wall 60 that is attached to and extends between the front 56 and back 58 walls defining an inner space 62. The reservoir 54 holds the fluid within the inner space 62. The peripheral wall 60 generally has a top side 64, a bottom side 66, a first lateral side 68, and a second lateral side 70. The housing 12 may be coupled to the reservoir 54 and positioned on the front wall 56 of the reservoir 54, for example such that the top edge 22 of the housing 12 is adjacent to the top side 64 of the peripheral wall 60.

A spout 72 may be fluidly coupled to the reservoir 54. The spout 72 has an upper edge 74 defining an opening 76 into the inner space 62. The fluid may be added to the inner space 62 through the opening 76. In FIG. 1, the spout 72 is positioned on the top side 64, although the spout 72 may alternatively be positioned on the first 68 or second 70 lateral sides. The spout 72 may also be positioned on the bottom side 66, although that may increase the risk that the fluid will drain out of the inner space 62 through the spout 72 because of the gravitational forces being exerted on the fluid. A cap 78 may be removably couplable to the spout 72 to selectively close the opening 76.

A coupler 80 may be attached to the back wall 58 of the reservoir 54. The coupler 80 is generally configured to removably couple the reservoir 54 to a surface, such as a shower wall, where the back scrubbing device 10 is being used. In the example shown in FIG. 2, the coupler 80 comprises a suction cup.

A pump 82 is fluidly coupled to the reservoir 54. The pump 82 may be positioned in the inner space 62, for example being adjacent to the bottom side 66 as shown in FIG. 1. The pump 82 is configured to receive and pressurize the fluid. The pump 82 is electronically coupled to and controlled by the processor 24.

A hose 84 is fluidly coupled to the pump 82 and the container 50. The hose 84 directs the fluid from the pump 84 to the container 50 when the fluid is pressurized.

A nozzle 86 is fluidly coupled to the container 50 and to the brush assembly 30. The nozzle 86 is exposed within the panel 32 above the brush 36 whereby the nozzle 86 dispenses the cleaning solution onto the brush 36. For example, the nozzle 86 may include a first nozzle tip 88 that is positioned above the first brush head 38, a second nozzle tip 90 that is positioned above the second brush head 40, and a third nozzle tip 92 that is positioned above the third brush head 42. Each of the first 88, second 90, and third 92 nozzle tips may dispense the cleaning solution onto the respective one of the first 38, second 40, and third 42 brush heads as the drive mechanism 44 moves the brush 38 over the vertical, or longitudinal, plane of the panel 32.

A tube assembly 94 fluidly couples the container 50 with the brush assembly 30. The tube assembly 94 directs the cleaning solution from the container 50 to the nozzle 86. For example, the tube assembly 94 may include a first tube 94 fluidly coupling the first nozzle tip 88 with the container 50, a second tube 98 fluidly coupling the second nozzle tip 90 with the container 50, and a third tube 100 fluidly coupling the third nozzle tip 92 with the container 50.

Figure 7:
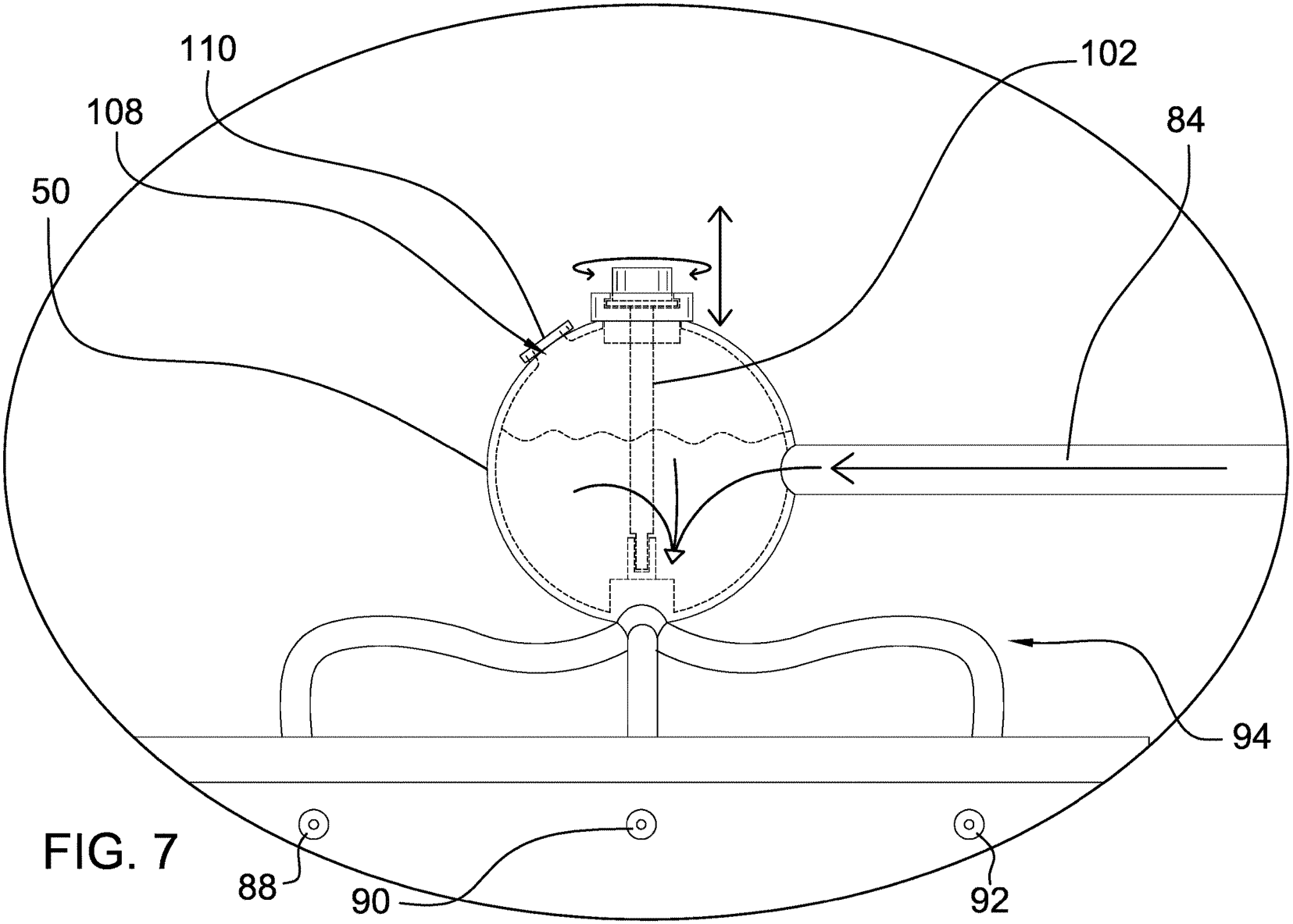
FIG. 7 is a detail view of an embodiment of the disclosure.
Figure 8:
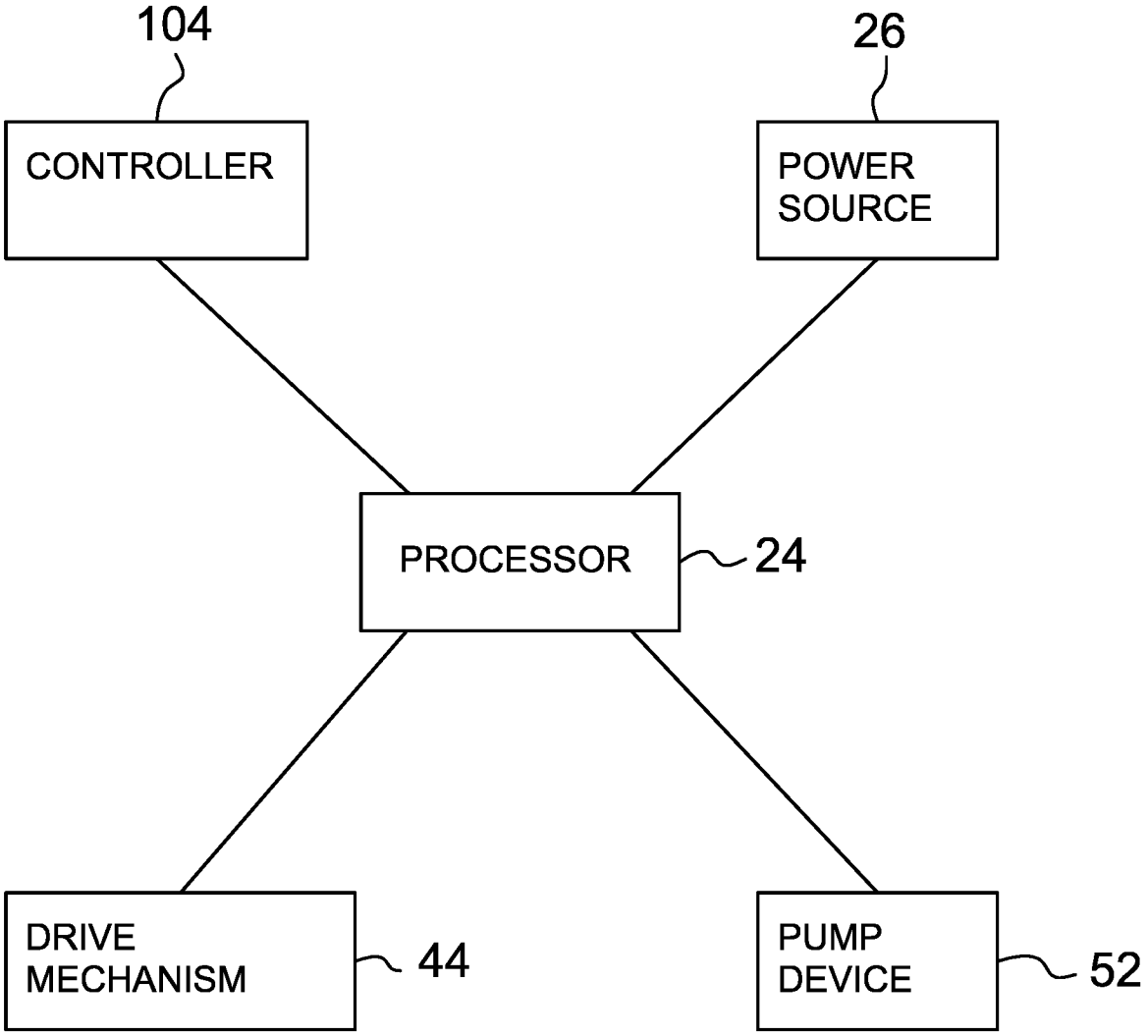
FIG. 8 is a block diagram view of an embodiment of the disclosure.

As shown in FIG. 7, a valve 102 may be coupled to the container 50 and the tube assembly 94. The valve 102 is generally configured to control a flow rate of the cleansing solution being directed from the container 50 to the nozzle 86.

A control 104 may be positioned on the housing 12 that is electronically coupled to the processor 24. The control 104 may be configured to actuate the processor 24 to turn on and off the drive mechanism 44 and the pump device 52. For example, the control 104 may comprise a plurality of buttons 106 that is mounted on the first wall 14.

In use, the user can fill the reservoir 54 with the fluid, which may comprise water. The user can then actuate the processor 24 to turn on the pump device 52. The pump device 52 will generally pressurize the fluid and draw the fluid through the hose 84 and into the container 50, where the fluid will mix with the cleanser to form the cleaning solution. The cleaning solution will travel to the nozzle 86 where the cleaning solution is expelled over the brush 36 through the tube assembly 94. The drive mechanism 44 will move the brush 36 vertically up and down over the panel 32. The user can lean backwards into the panel 32 so that the first 38, second 10, and third 42 brush heads move up and down over the back of the user. The user can also lean into the panel 32 to clean other body parts, such as a torso or an arm, without needing to use the hands of the user. Because the panel 32 is angled relative to the housing 12, the brush 36 should be angled to receive the back, or other body part, of the user as the user leans toward the back scrubbing device 10. The user can manipulate the control 104, for example by pushing one of the plurality of buttons 106, to turn the back scrubbing device 10 on and off. The back scrubbing device 10 can be stored in a shower or other bathing area, for example being releasably coupled to the shower wall with the coupler 80 that is attached to the back wall 58 of the reservoir 54.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal cleaning apparatus comprising:

a housing having a first wall, a second wall, and a perimeter wall being attached to and extending between the first and second walls defining an interior area, the first wall having a top edge;

a processor being positioned in the interior area;

a brush assembly being coupled to the housing and electronically coupled to the processor, the brush assembly including:

a panel being coupled to the first wall, the panel extending upwardly from the top edge;

a brush being movably coupled to the panel, the brush moving along a longitudinal plane of the panel;

a drive mechanism being coupled to the brush, the drive mechanism moving the brush vertically over the longitudinal plane of the panel;

a container being fluidly coupled to the brush assembly, the container being configured to hold a cleanser;

a pump device being coupled to the housing and electronically coupled to the processor, the pump device being configured to direct a fluid into the container, the fluid mixing with the cleanser when the fluid is directed into the container thereby forming a cleaning solution; and a nozzle being fluidly coupled to the container and to the brush assembly, the nozzle being exposed within the panel above the brush whereby the nozzle dispenses the cleaning solution onto the brush.

2. The personal cleaning apparatus of claim 1, further comprising a power source being positioned in the interior area and electronically coupled to the processor.

3. The personal cleaning apparatus of claim 2, the power source further comprising a battery.

4. The personal cleaning apparatus of claim 3, wherein the battery is rechargeable.

5. The personal cleaning apparatus of claim 2, further comprising a charging port being electronically coupled to the power source, the charging port being inset into the housing and exposed within the perimeter wall.

6. The personal cleaning device of claim 1, wherein the panel is angled relative to the top edge.

7. The personal cleaning device of claim 1, the drive mechanism further comprising:

a motor being coupled to the processor; and an actuator being electronically coupled to the motor and being mechanically coupled to the brush, the actuator being a linear actuator.

8. The personal cleaning device of claim 1, the brush further comprising a first brush head, a second brush head, and a third brush head, each of the first, second, and third brush heads being spaced from each other across a transverse plane of the panel.

9. The personal cleaning device of claim 8, the nozzle further comprising a first nozzle tip being positioned above the first brush head, a second nozzle tip being positioned above the second brush head, and a third nozzle tip being positioned above the third brush head.

10. The personal cleaning device of claim 9, further comprising a first tube fluidly coupling the first nozzle tip with the container, a second tube fluidly coupling the second nozzle tip with the container, and a third tube fluidly coupling the third nozzle tip with the container.

11. The personal cleaning apparatus of claim 1, the pump device further comprising:

a reservoir being configured to hold the fluid, the reservoir having a front wall, a back wall, and a peripheral wall being attached to and extending between the front and back walls to define an inner space, a pump being fluidly coupled to the reservoir, the pump being positioned in the inner space, the pump being configured to receive and pressurize the fluid, the pump being electronically coupled to the processor; and a hose being fluidly coupled to the pump and the container, the hose directing the fluid from the pump to the container when the fluid is pressurized.

12. The personal cleaning apparatus of claim 11, the peripheral wall of the reservoir further comprising a top side, a bottom side, a first lateral side, and a second lateral side, the reservoir further comprising a coupler being attached to the back wall, the coupler being configured to removably couple the reservoir to a surface.

13. The personal cleaning apparatus of claim 11, the reservoir further comprising:

a spout being fluidly coupled to the reservoir, the spout having an upper edge defining an opening into the inner space; and a cap being removably couplable to the spout to close the opening.

14. The personal cleaning apparatus of claim 1, further comprising a tube assembly fluidly coupling the container with the brush assembly, the tube assembly directing the cleaning solution from the container to the nozzle.

15. The personal cleaning device of claim 14, further comprising a valve being coupled to the container and the tube assembly, the valve being configured to control a flow rate of the cleansing solution being directed from the container to the nozzle.

16. The personal cleaning device of claim 1, further comprising a control being positioned on the housing and being electronically coupled to the processor, the control being configured to actuate the processor to turn on and off the drive mechanism and the pump device.

17. The personal cleaning device of claim 16, the control further comprising a plurality of buttons being mounted on the first wall.

18. The personal cleaning device of claim 1, the panel further comprising a bottom edge being adjacent to and coplanar with the top edge of the housing.

19. A personal cleaning apparatus comprising:

a housing having a first wall, a second wall, and a perimeter wall being attached to and extending between the front and second walls defining an interior area, the first wall having a top edge;

a processor being positioned in the interior area;

a power source being positioned in the interior area and electronically coupled to the processor, the power source comprising a battery, the battery being rechargeable;

a charging port being electronically coupled to the power source, the charging port being inset into the housing and exposed within the housing;

a brush assembly being coupled to the housing and electronically coupled to the processor, the brush assembly comprising:

a panel being coupled to the first wall, the panel extending upwardly from the top edge, the panel being angled relative to the top edge, the panel having a bottom edge being adjacent to and coplanar with the top edge of the housing;

a brush being movably coupled to the panel, the brush moving along a longitudinal plane of the panel, the brush including a first brush head, a second brush head, and a third brush head, each of the first, second, and third brush heads being aligned with each other and spaced from each other across a transverse plane of the panel;

a drive mechanism being coupled to the brush, the drive mechanism moving the brush vertically over the longitudinal plane of the panel, the drive mechanism comprising:

a motor being coupled to the processor;

an actuator being electronically coupled to the motor and being mechanically coupled to the brush, the actuator being a linear actuator;

a container being fluidly coupled to the brush assembly, the container being configured to hold a cleanser;

a pump device being coupled to the housing and electronically coupled to the processor, the pump device being configured to direct a fluid into the container, the fluid mixing with the cleanser when the fluid is pumped into the container thereby forming a cleaning solution, the pump device comprising:

a reservoir being configured to hold the fluid, the reservoir having a front wall, a back wall, and a peripheral wall being attached to and extending between the front and back walls defining an inner space, the peripheral wall having a top side, a bottom side, a first lateral side, and a second lateral side, the reservoir including:

a spout being fluidly coupled to the reservoir, the spout having an upper edge defining an opening into the inner space, the spout being positioned on the top side;

a cap being removably couplable to the spout to close the opening;

a coupler being attached to the back wall, the coupler being configured to removably couple the reservoir to a surface, the coupler comprising a suction cup;

a pump being fluidly coupled to the reservoir, the pump being positioned in the inner space, the pump being configured to receive and pressurize the fluid, the pump being electronically coupled to the processor;

a hose being fluidly coupled to the pump and the container, the hose directing the fluid from the pump to the container when the fluid is pressurized;

a nozzle being fluidly coupled to the container and to the brush assembly, the nozzle being exposed within the panel above the brush whereby the nozzle dispenses the cleaning solution onto the brush, the nozzle including a first nozzle tip being positioned above the first brush head, a second nozzle tip being positioned above the second brush head, and a third nozzle tip being positioned above the third brush head;

a tube assembly fluidly coupling the container with the brush assembly, the tube assembly directing the cleaning solution from the container to the nozzle, the tube assembly including a first tube coupling the first nozzle tip with the container, a second tube coupling the second nozzle tip with the container, and a third tube coupling the third nozzle tip with the container;

a valve being coupled to the container and the tube assembly, the valve being configured to control a flow rate of the cleansing solution being directed from the container to the nozzle; and a control being positioned on the housing and being electronically coupled to the processor, the control being configured to actuate the processor to turn on and off the drive mechanism and the pump device, the control comprising a plurality of buttons being mounted on the first wall.

* * * * *